US008047870B2

(12) United States Patent
Clausen

(10) Patent No.: US 8,047,870 B2
(45) Date of Patent: Nov. 1, 2011

(54) COAXIAL CONNECTOR FOR CORRUGATED CABLE

(75) Inventor: Jan Michael Clausen, Vordingborg (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/652,471

(22) Filed: Jan. 5, 2010

(65) Prior Publication Data

US 2010/0178800 A1 Jul. 15, 2010

Related U.S. Application Data

(60) Provisional application No. 61/143,503, filed on Jan. 9, 2009.

(51) Int. Cl.
*H01R 9/05* (2006.01)

(52) U.S. Cl. ..... 439/578; 439/583

(58) Field of Classification Search ..... 439/578, 439/583–585

See application file for complete search history.

(56) References Cited

U.S. PATENT DOCUMENTS

| | | | | |
|---|---|---|---|---|
| 3,199,061 | A | 8/1965 | Johnson et al. | 339/100 |
| 3,291,895 | A | 12/1966 | Van Dyke | 174/88 |
| 4,046,451 | A | 9/1977 | Juds et al. | 339/177 R |
| 5,137,470 | A | 8/1992 | Doles | 439/578 |
| 5,154,636 | A | 10/1992 | Vaccaro et al. | 439/583 |
| 5,167,533 | A | 12/1992 | Rauwolf | 439/583 |
| 5,435,745 | A | 7/1995 | Booth | 439/584 |
| 5,518,420 | A | 5/1996 | Pitschi | 439/578 |
| 5,766,037 | A | 6/1998 | Nelson | 439/583 |
| 5,984,723 | A | 11/1999 | Wild | 439/583 |
| 6,109,964 | A | 8/2000 | Kooiman | 439/583 |
| 6,331,123 | B1 * | 12/2001 | Rodrigues | 439/584 |
| 6,802,738 | B1 | 10/2004 | Henningsen | 439/583 |
| 6,824,415 | B2 | 11/2004 | Wlos | 439/348 |
| 6,840,803 | B2 | 1/2005 | Wlos et al. | 439/585 |
| 6,893,290 | B2 | 5/2005 | Buenz et al. | 439/578 |
| 6,994,587 | B2 | 2/2006 | Buenz et al. | 439/578 |
| 7,134,189 | B2 | 11/2006 | Buenz et al. | 29/748 |
| 7,189,114 | B1 | 3/2007 | Burris et al. | 439/578 |
| 7,189,115 | B1 | 3/2007 | Montena | 439/584 |
| 7,217,154 | B2 | 5/2007 | Harwath | 439/578 |
| 7,351,101 | B1 | 4/2008 | Montena | 439/584 |
| 7,435,135 | B2 * | 10/2008 | Wlos | 439/584 |
| 7,458,851 | B2 | 12/2008 | Montena | 439/584 |
| 7,566,243 | B1 * | 7/2009 | Hung | 439/578 |
| 7,607,942 | B1 * | 10/2009 | Van Swearingen | 439/578 |
| 7,824,215 | B2 * | 11/2010 | Islam et al. | 439/578 |
| 2008/0274643 | A1 | 11/2008 | Chawgo | 439/583 |

FOREIGN PATENT DOCUMENTS

| | | |
|---|---|---|
| EP | 1122835 | 8/2001 |
| EP | 1148592 | 10/2001 |
| EP | 1170833 | 1/2002 |
| GB | 2 277 207 | 10/1994 |
| WO | WO2004/055943 | 7/2004 |

* cited by examiner

*Primary Examiner* — Thanh Tam Le
(74) *Attorney, Agent, or Firm* — Matthew J. Mason

(57) ABSTRACT

A coaxial cable connector includes an internal corrugated area, an internal clamping member, and a back nut. Axial advancement of the back nut causes at least a portion of the internal clamping member to compress radially inwardly.

14 Claims, 7 Drawing Sheets

COAXIAL CONNECTOR FOR CORRUGATED CABLE

CROSS-REFERENCE TO RELATED APPLICATIONS

This application claims the benefit of, and priority to U.S. Provisional Patent Application No. 61/143,503 filed on Jan. 9, 2009 entitled, "Coaxial Connector For Corrugated Cable", the content of which is relied upon and incorporated herein by reference in its entirety.

BACKGROUND OF THE INVENTION

1. Field of the Invention

The present invention relates generally to connectors for coaxial cables, and particularly to connectors for coaxial cables that have helically corrugated outer conductors.

2. Technical Background

Coaxial cable is characterized by having an inner conductor, an outer conductor, and an insulator between the inner and outer conductors. The inner conductor may be hollow or solid. At the end of coaxial cable, a connector is attached to allow for mechanical and electrical coupling of the coaxial cable.

Connectors for coaxial cables have been used throughout the coaxial cable industry for a number of years, including connectors for coaxial cables having helically corrugated outer conductors. Accordingly, there is a continuing need for improved high performance coaxial cable connectors.

SUMMARY OF THE INVENTION

One aspect of the invention is a coaxial cable connector configured to provide an electrically conductive coupling to a coaxial cable. The coaxial cable includes a center conductor, a cable jacket, and an outer conductor. The coaxial cable connector includes a body that includes a front end, a back end, and an internal bore. The coaxial cable connector also includes a coupling nut rotatably secured to the front end of the body. In addition, the coaxial cable connector includes a back nut rotatably secured to the back end of the body. The back nut includes an internal bore. The coaxial cable connector further includes an internally corrugated member at least partially disposed within the internal bore of the body. The internally corrugated member includes a front end and a back end and an internal corrugated area. Additionally, the coaxial cable connector includes an internal clamping member at least partially disposed within the internal bore of the back nut. Axial advancement of the back nut in the direction of the front end of the body causes at least a portion of the internal clamping member to compress radially inwardly.

In another aspect, the present invention includes a coaxial connector wherein the body and internally corrugated member as described above are combined into a single unitary body. Specifically, the coaxial cable connector includes a body that includes a front end, a back end, and an internal corrugated area. The coaxial cable connector also includes a coupling nut rotatably secured to the front end of the body. In addition, the coaxial cable connector includes a back nut rotatably secured to the back end of the body. The back nut includes an internal bore. The coaxial cable connector further includes an internal clamping member at least partially disposed within the internal bore of the back nut. Axial advancement of the back nut in the direction of the front end of the body causes at least a portion of the internal clamping member to compress radially inwardly.

In yet another aspect, the present invention provides a method of coupling a coaxial cable to a coaxial cable connector. The method includes inserting a prepared end of a coaxial cable into either of the two types of coaxial cable connectors described above. In addition, the method includes axially advancing the back nut in the direction of the front end of the body thereby causing at least a portion of the internal clamping member to compress radially inwardly.

Preferred embodiments of the present invention can provide for at least one potential advantage including, but not limited to, simplified connector installation, simplified connector component geometry, positive mechanical captivation of cable along multiple contact points, reduced installation time, installation or removal without the use of special tools, and/or improved electrical performance (common path distortion) due to connector/cable junction stability.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
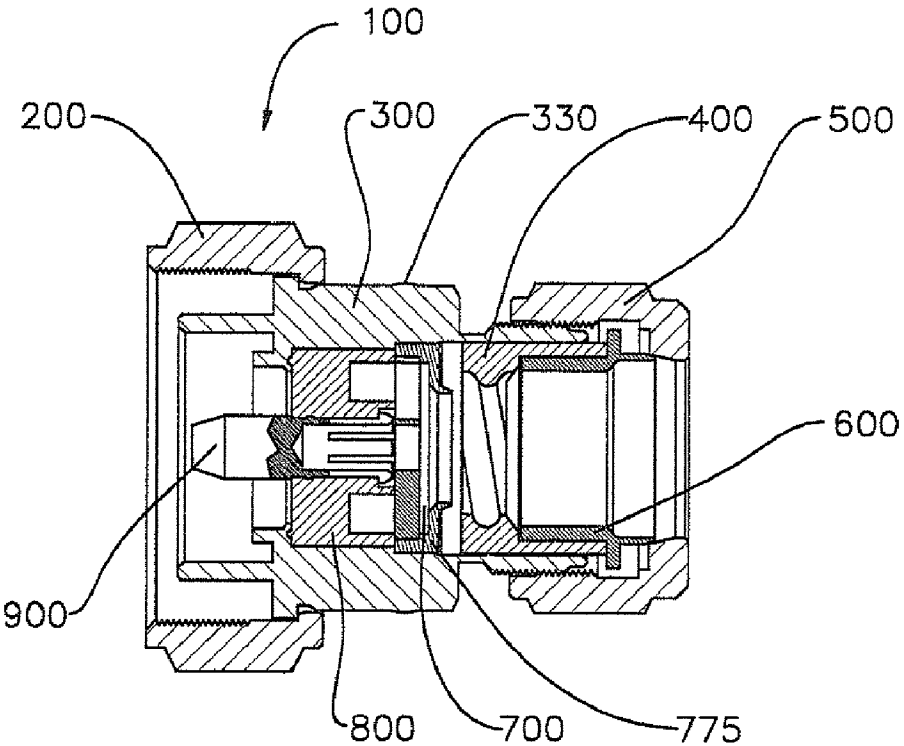
FIG. 1 illustrates a partial cross sectional view of a first embodiment of the present invention.

FIG. 1 illustrates a partial cross sectional view of a first preferred embodiment of the invention in which connector 100 is shown in a state ready to receive a corrugated coaxial cable. In FIG. 1, insulator 800, contact 900, insulator 700, ring 775 and internally corrugated member 400, have been factory installed into, and secured within body 300, by means of a light, temporary press fit between body 300 and internally corrugated member 400. Coupling nut 200 is secured about body 300 by means of pressing coupling nut 200 past a light interference over bump 330 thereby allowing coupling nut 200 to rotate about body 300 with limited axial movement. Internal clamping member 600 is nested within back nut 500. Preferably, back nut 500 does not directly contact internally corrugated member 400.

Figure 2:
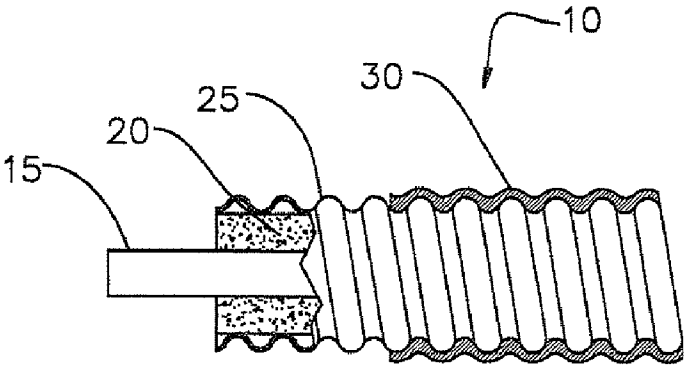
FIG. 2 illustrates a partial cross sectional view of a prepared end of a corrugated coaxial cable.

FIG. 2 illustrates a partial cross sectional view of the prepared end of a corrugated coaxial cable 10 including center conductor 15, dielectric 20, corrugated outer conductor 25, and cable jacket 30.

Figure 3:
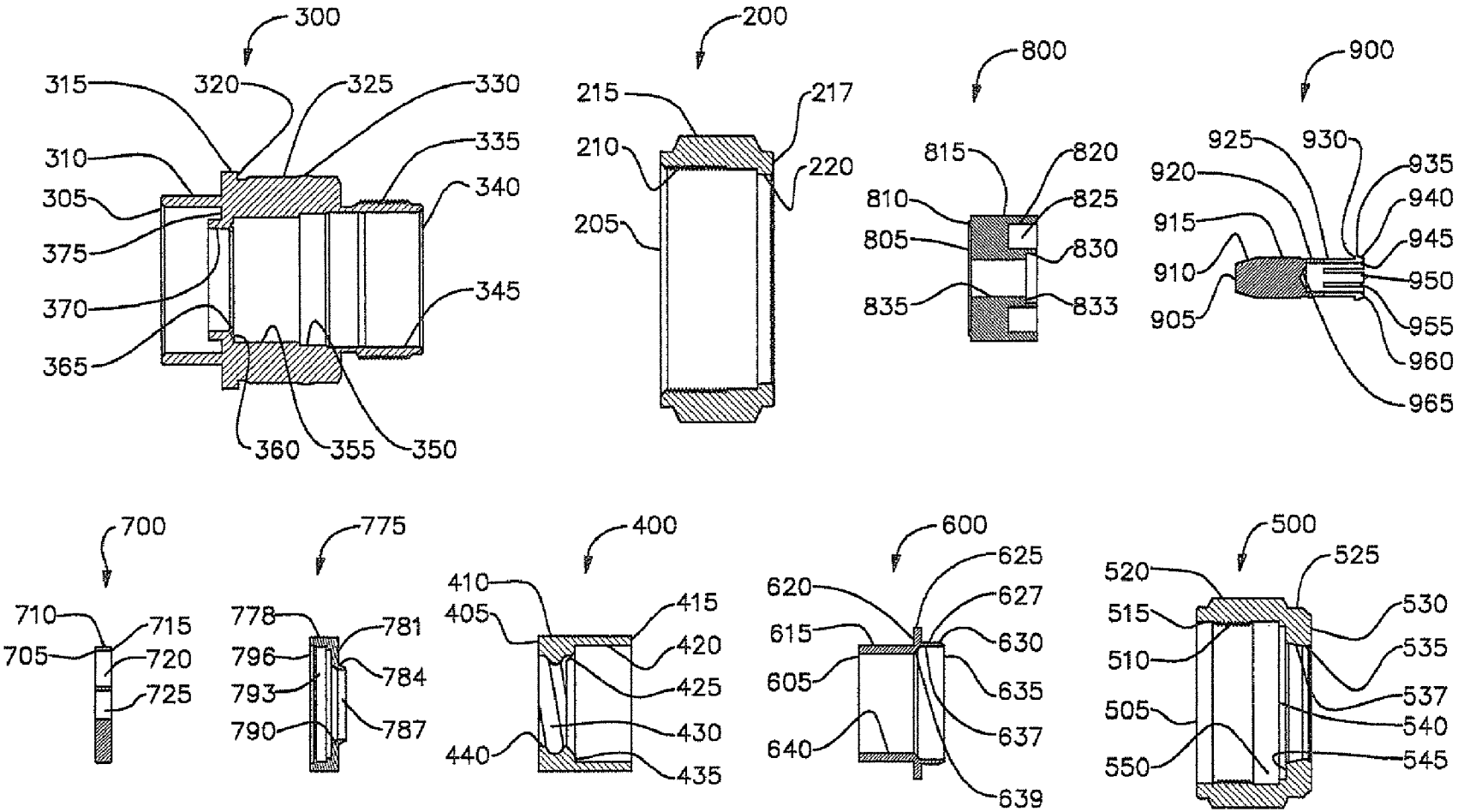
FIG. 3 illustrates an exploded view of the embodiment illustrated in FIG. 1.

FIG. 3 illustrates an exploded view of a preferred embodiment of connector 100 including body 300, coupling nut 200, insulator 800, contact 900, insulator 700, ring 775, internally corrugated member 400, internal clamping member 600, and back nut 500. Moving from left to right across FIG. 3:

Body 300 includes front end 305, interface outside diameter 310, outer diameter 315, rearward facing annular shoulder 320, outer diameter 325, bump 330, externally threaded portion 335, back end 340, internal bores 345, 350, and 355, rearward facing annular groove 360, through-bore 365, internal bore 370, and trepan 375. Body 300 is preferably made from a metallic material, such as brass, and is preferably plated with a conductive, corrosion resistant material, such as a nickel-tin alloy.

Coupling nut 200 includes front end 205, internally threaded portion 210, outer surface 215, back end 217, and through-bore 220. Coupling nut 200 is preferably made from a metallic material, such as brass, and is preferably plated with a conductive, corrosion resistant material, such as a nickel-tin alloy.

Insulator 800 includes front end 805, raised tapered annular ring 810, outside diameter 815, back end 820, a plurality of impedance matching holes 825, internal bore 830, reward facing annular surface 833 and through-bore 835. Insulator 800 is preferably made from an electrically insulative material, such as polymethylpentene commercially known as TPX®.

Contact 900 includes front end 905, tapered portion 910, straight portion 915, bump 920, outer diameter 925, forward facing annular shoulder 930, outer diameter 935, tapered portion 940, internal bore 945, a plurality of contact tines 950, a plurality of slots 955, back end 960, and optional bore 965. Contact 900 is preferably made from a metallic material, such as beryllium copper, is preferably heat treated and is preferably plated with a conductive, corrosion resistant material, such as a nickel-tin alloy.

Insulator 700 includes front end 705, outside diameter 710, back end 715, a plurality of impedance matching holes 720, and through-bore 725. Insulator 700 is preferably made from an electrically insulative material, such as acetal commercially known as Delrin®.

Ring 775 includes front end 796, outside diameter 778, back end 781, tapered protrusion 784, through-bore 787, internal tapered area 790 and internal bore 793. Ring 775 is preferably made from a metallic material, such as brass, and is preferably plated with a conductive, corrosion resistant material, such as silver.

Internally corrugated member 400 includes front end 405, outer diameter 410, back end 415, internal bore 420, internal tapered portion 425, internal corrugated area 430, rearward facing annular shoulder 435, and through-bore 440. The length of the internal bore 420 in the axial direction is preferably at least as long as the length of the internal corrugated area 430 in the axial direction. That is, internal corrugated area 430 preferably makes up no more than 50% of the axial length of the internally corrugated member 400. Internally corrugated member 400 is preferably made from a metallic material, such as brass, and is preferably plated with a conductive, corrosion resistant material, such as a nickel-tin alloy.

Internal clamping member 600 includes front end 605, outer diameter 615, forward facing annular shoulder 620, outer diameter 625, outer diameter 627, chamfer 630, back end 635, counter bore 637, tapered transition area 639, and through-bore 640. Internal clamping member 600 is preferably made from a conformable plastic material, such as acetal commercially known as Delrin®.

Back nut 500 includes front end 505, internally threaded portion 510, counter bore 515, external shape 520, outside diameter 525, back end 530, through-bore 535, internal tapered portion 537, counter bore 540, forward facing annular shoulder 545, and internal bore 550. Back nut 500 is preferably made from a metallic material, such as brass, and is preferably plated with a conductive, corrosion resistant material, such as a nickel-tin alloy.

Figure 4:
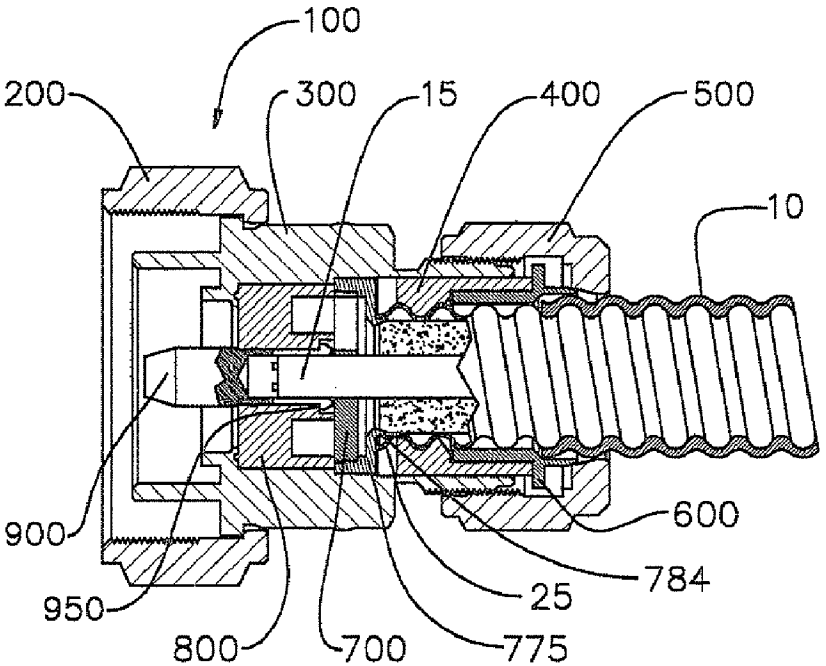
FIG. 4 illustrates a partial cross sectional view of the embodiment illustrated in FIG. 1 in a first stage of assembly with a corrugated coaxial cable.

FIG. 4 illustrates connector 100 at a first stage of assembly wherein prepared end of cable 10 is inserted into connector 100 through internal clamping member 600 and back nut 500 respectively. Cable outer conductor 25 is engaged with internally corrugated member 400. The interior of cable outer conductor 25 is annularly disposed about tapered protrusion 784 of ring 775. Cable center conductor 15 passes through insulator 700 and is mechanically and electrically in communication with contact 900 by means of radial inward compressive forces exerted by a plurality of contact tines 950.

Figure 5:
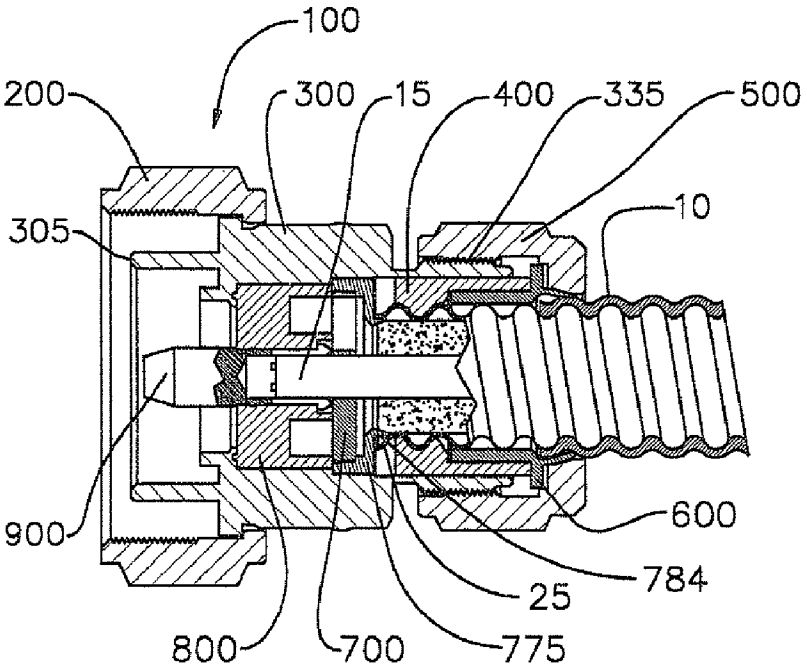
FIG. 5 illustrates a partial cross sectional view of the embodiment illustrated in FIG. 1 in a second stage of assembly with a corrugated coaxial cable.

FIG. 5 illustrates a partial cross sectional view with the connector 100 and cable 10 at a second stage of assembly wherein back nut 500 is threadedly advanced upon threaded portion 335 of body 300 thereby axially advancing back nut 500 in the direction of front end 305 of body 300 and initiating radially inwardly compressive movement of internal clamping member 600.

Figure 6:
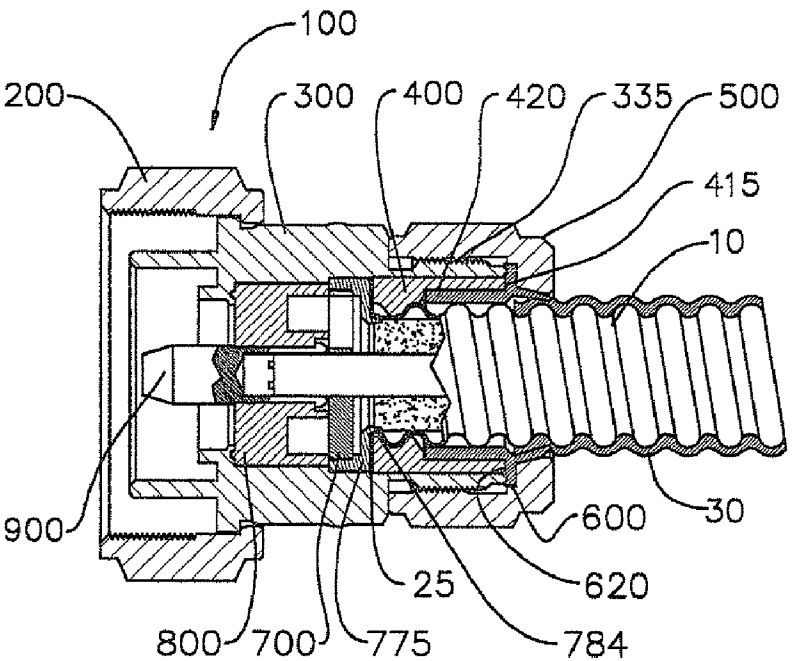
FIG. 6 illustrates a partial cross sectional view of the embodiment illustrated in FIG. 1 in a final stage of assembly with a corrugated coaxial cable.

FIG. 6 illustrates a partial cross sectional view with the connector 100 and cable 10 at a third and final stage of assembly. Back nut 500 is fully tightened onto threaded portion 335 of body 300 fully compressing internal clamping member 600. Forward facing annular shoulder 620 of internal clamping member 600 abuts against back end 415 of internally corrugated member 400. Internal clamping member 600 is at least partially disposed within the internal bore 420 of the internally corrugated member 400 and contacts the internally corrugated member 400, cable jacket 30, and the back nut 500. Internal clamping member 600 conforms or at least partially conforms to contours of body 300, cable jacket 30 and back nut 500, causing at least a portion of internal clamping member 600 to compress radially inwardly and providing mechanical support and environmental sealing. Cable outer conductor 25 is formed against internally corrugated member 400 and clamped or sandwiched between internally corrugated member 400 and tapered protrusion 784 of ring 775 providing electrical and mechanical communication between connector 100 and cable 10.

Figure 7:
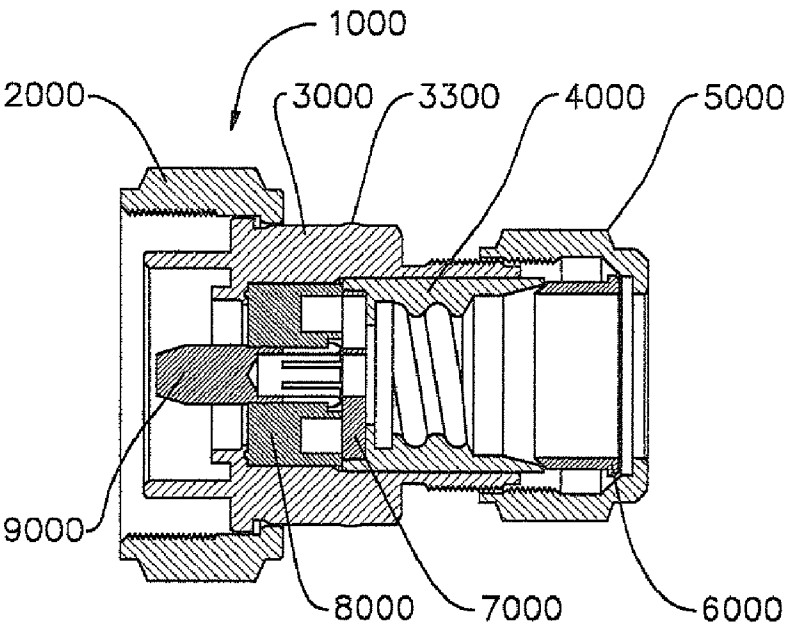
FIG. 7 illustrates a partial cross sectional view of an alternative embodiment of the present invention.

FIG. 7 illustrates a partial cross sectional view of an alternate preferred embodiment of the invention in which connector 1000 is shown in a state ready to receive a corrugated coaxial cable. In FIG. 7, insulator 8000, contact 9000, insulator 7000 and internally corrugated member 4000, have been factory installed into, and secured within body 3000, by means of a press fit between body 3000 and internally corrugated member 4000. Coupling nut 2000 is secured about body 3000 by means of pressing coupling nut 2000 past a light interference over bump 3300 thereby allowing coupling nut 2000 to rotate about outer body 3000 with limited axial movement. Internal clamping member 6000 is nested within back nut 5000. Preferably, back nut 5000 does not directly contact internally corrugated member 4000.

Figure 8:
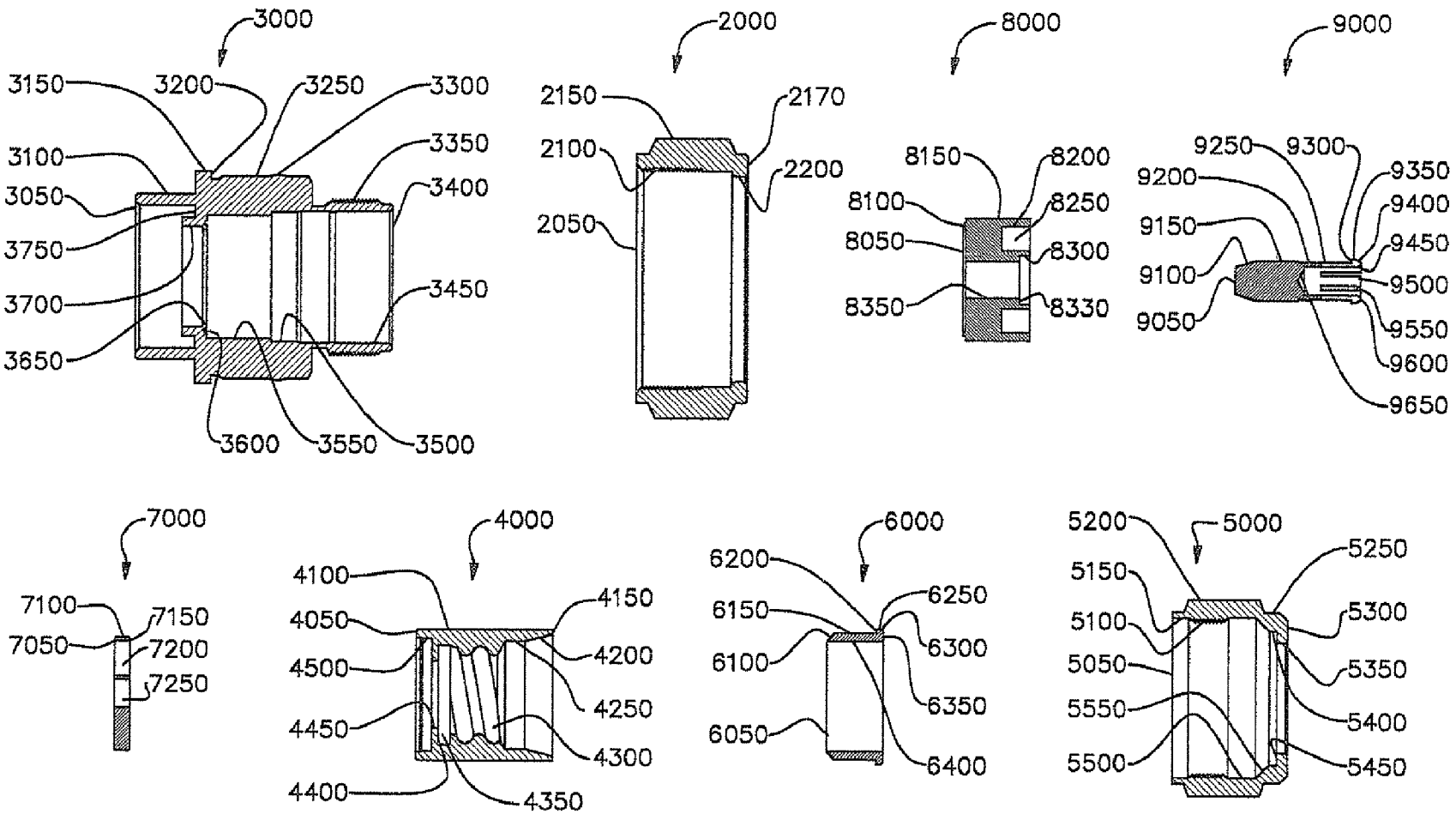
FIG. 8 illustrates an exploded view of the embodiment illustrated in FIG. 7.

FIG. 8 illustrates an exploded view of a preferred embodiment of connector 1000 including body 3000, coupling nut 2000, insulator 8000, contact 9000, insulator 7000, internally corrugated member 4000, internal clamping member 6000, and within back nut 5000. Moving from left to right across FIG. 8.

Body 3000 includes front end 3050, interface outside diameter 3100, outer diameter 3150, rearward facing annular shoulder 3200, outer diameter 3250, bump 3300, externally threaded portion 3350, back end 3400, internal bore 3450, internal bore 3500, internal bore 3550, rearward facing annular groove 3600, through-bore 3650, internal bore 3700, and trepan 3750. Front body 3000 is preferably made from a metallic material, such as brass, and is preferably plated with a conductive, corrosion resistant material, such as a nickel-tin alloy.

Coupling nut 2000 includes front end 2050, internally threaded portion 2100, outer surface 2150, back end 2170, and through-bore 2200. Coupling nut 2000 is preferably made from a metallic material, such as brass, and is preferably plated with a conductive, corrosion resistant material, such as a nickel-tin alloy.

Insulator 8000 includes front end 8050, raised tapered annular ring 8100, outside diameter 8150, back end 8200, a plurality of impedance matching holes 8250, internal bore 8300, and through-bore 8350. Insulator 8000 is preferably made from an electrically insulative material, such as polymethylpentene commercially known as TPX®.

Contact 9000 includes front end 9050, tapered portion 9100, straight portion 9150, bump 9200, outer diameter 9250, forward facing annular shoulder 9300, outer diameter 9350, tapered portion 9400, internal bore 9450, a plurality of contact tines 9500, a plurality of slots 9550, back end 9600, and optional bore 9650. Contact 9000 is preferably made from a metallic material, such as beryllium copper, is preferably heat treated and is preferably plated with a conductive, corrosion resistant material, such as a nickel-tin alloy.

Insulator 7000 includes front end 7050, outside diameter 7100, back end 7150, a plurality of impedance matching holes 7200, and through-bore 7250. Insulator 7000 is preferably made from an electrically insulative material, such as acetal commercially known as Delrin®.

Internally corrugated member 4000 includes front end 4050, outer diameter 4100, back end 4150, internal tapered portion 4200, internal bore 4250, internal corrugated area 4300, internal annular groove 4350, rearward facing annular shoulder 4400, through-bore 4450, and counterbore 4500. The combined lengths of the internal tapered portion 4200, internal bore 4250, internal annular groove 4350, through-bore, 4450, and counterbore 4500 in the axial direction are preferably as least as long as the length of the internal corrugated area 4300 in the axial direction. That is, internal corrugated area 4300 preferably makes up no more than 50% of the axial length of the internally corrugated member 4000. Internally corrugated member 4000 is preferably made from a metallic material, such as brass, and is preferably plated with a conductive, corrosion resistant material, such as a nickel-tin alloy.

Internal clamping member 6000 includes front end 6050, front chamfer 6100, outer diameter 6150, forward facing annular shoulder 6200, outer diameter 6250, chamfer 6300, back end 6350, and through-bore 6400. Internal clamping member 6000 is preferably made from a conformable plastic material, such as acetal commercially known as Delrin®.

Back nut 5000 includes front end 5050, internally threaded portion 5100, counter bore 5150, external shape 5200, outside diameter 5250, back end 5300, through-bore 5350, counter bore 5400, forward facing annular shoulder 5450, internal bore 5500, and internal tapered portion 5550. Back nut 5000 is preferably made from a metallic material, such as brass, and is preferably plated with a conductive, corrosion resistant material, such as a nickel-tin alloy.

Figure 9:
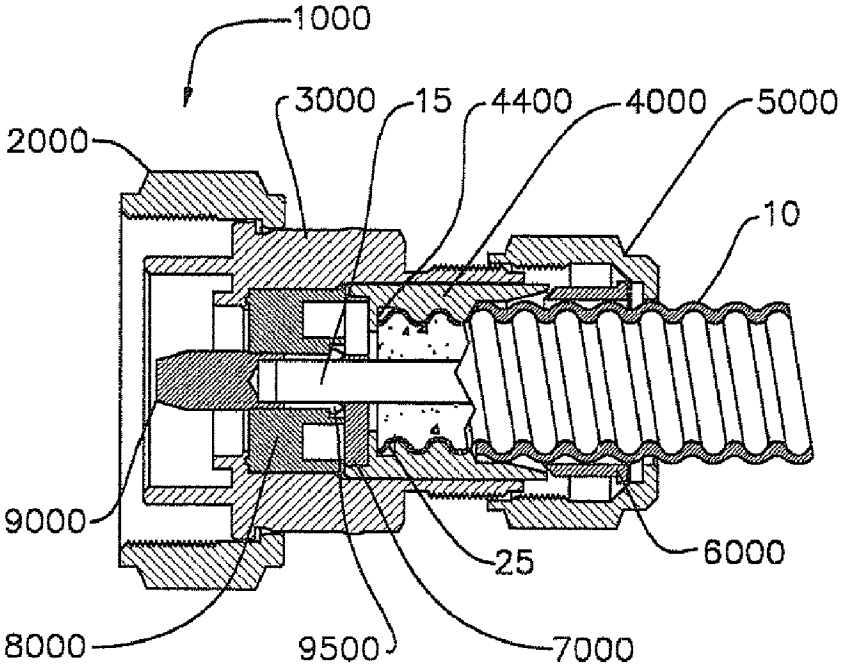
FIG. 9 illustrates a partial cross sectional view of the embodiment illustrated in FIG. 7 in a first stage of assembly with a corrugated coaxial cable.

FIG. 9 illustrates connector 1000 at a first stage of assembly wherein prepared end of cable 10 is inserted into connector 1000 through internal clamping member 6000 and back nut 5000 respectively. Cable outer conductor 25 is engaged with internally corrugated member 4000 and seated against rearward facing annular shoulder 4400. Cable center conductor 15 passes through insulator 7000 and is mechanically and electrically in communication with contact 9000 by means of radial inward compressive forces exerted by a plurality of contact tines 9500.

Figure 10:
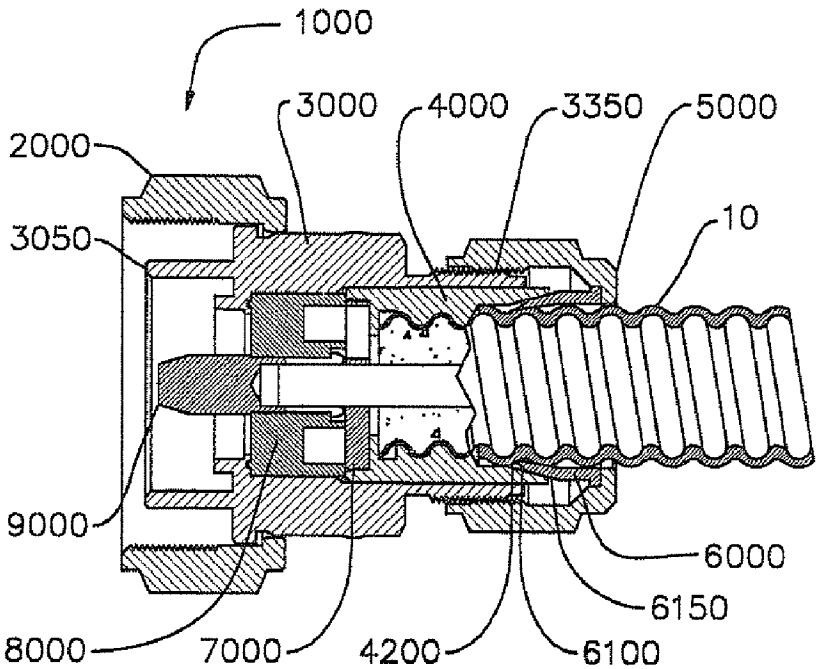
FIG. 10 illustrates a partial cross sectional view of the embodiment illustrated in FIG. 7 in a second stage of assembly with a corrugated coaxial cable.

FIG. 10 illustrates a partial cross sectional view with the connector 1000 and cable 10 at a second stage of assembly wherein back nut 5000 is threadedly advanced upon threaded portion 3350 of body 3000 thereby axially advancing back nut 5000 in the direction of front end 3050 of body 3000 and initiating axially forward and radially inwardly compressive movement of internal clamping member 6000 as front chamfer 6100 and outer diameter 6150 are driven along internal tapered surface 4200.

Figure 11:
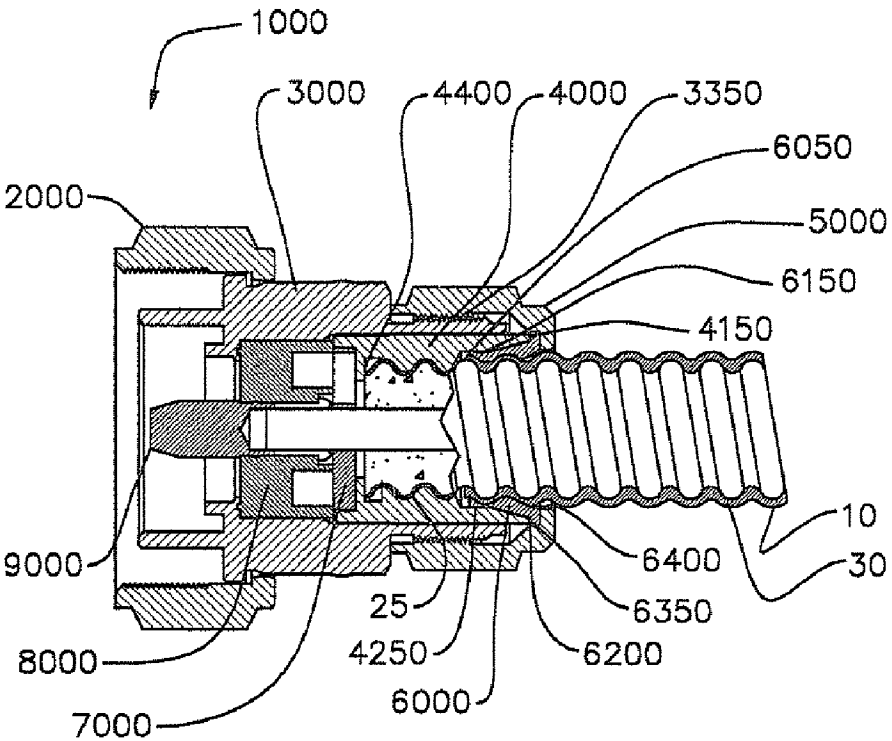
FIG. 11 illustrates a partial cross sectional view of the embodiment illustrated in FIG. 7 in a final stage of assembly with a corrugated coaxial cable.

FIG. 11 illustrates a partial cross sectional view with the connector and cable at a third and final stage of assembly. Back nut 5000 is fully tightened onto threaded portion 3350 of body 3000 fully axially advancing and radially inwardly compressing internal clamping member 6000. Forward facing annular shoulder 6200 of internal clamping member 6000 abuts against back end 4150 of internally corrugated member 4000. Internal clamping member 6000 is at least partially disposed within the internal bore 4250 of the internally corrugated member 4000 and contacts internally corrugated member 4000, cable jacket 30, and the back nut 5000. Internal clamping member 6000 conforms or at least partially conforms to contours of both body 3000 and cable jacket 30. In a preferred embodiment, front end 6050 of internal clamping member 6000 is compressed radially inwardly such that outer diameter 6150 of internal clamping member 6000 for at least one point proximate to front end 6050 is equal to or less than the diameter of through bore 6400 of internal clamping member 6000 for at least one point proximate to back end 6350 of internal clamping member 6000. Pressure exerted by the conformed structure of internal clamping member 6000 acts to firmly captivate and environmentally seal the cable/connector junction while maintaining forward pressure between cable outer conductor 25 and reward facing annular shoulder 4400 as well as maintaining forward pressure between multiple points of cable outer conductor 25 undulations and corresponding internal geometry of internally corrugated member 4000.

Figure 12:
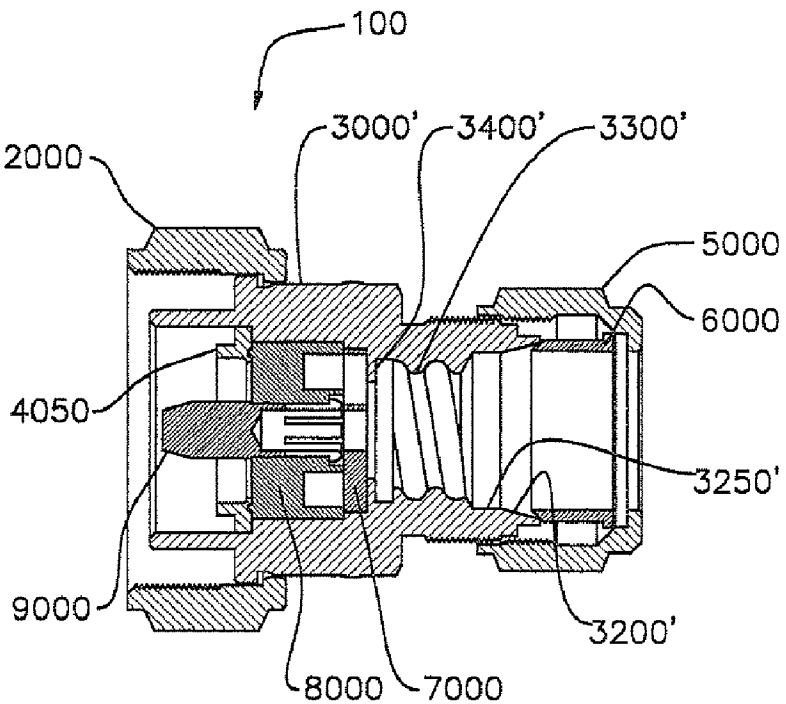
FIG. 12 illustrates a partial cross sectional view of another alternative embodiment of the present invention.

FIG. 12 illustrates a partial cross sectional view of yet another alternative embodiment of the invention wherein body 3000 and internally corrugated member 4000 from FIG. 7 are combined into a single unitary body 3000' having an internal corrugated area 3300', internal bore 3250', internal tapered portion 3200', and rearward facing annular shoulder 3400'. Insulator 7000, insulator 8000 and contact 9000 are retained within body 3000' by means of interface ring 4050 press-fitted into body 3000'. This embodiment is otherwise substantially identical to the embodiment set forth in FIG. 7 and assembly with a coaxial cable is otherwise substantially identical to the assembly illustrated in FIGS. 9-11.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial cable connector configured to provide an electrically conductive coupling to a coaxial cable comprising a center conductor, a cable jacket, and an outer conductor, the connector comprising:

a body comprising a front end, a back end, and an internal bore;

a coupling nut rotatably secured to the front end of the body;

a back nut rotatably secured to the back end of the body, the back nut comprising an internal bore;

an internally corrugated member at least partially disposed within the internal bore of the body, the internally corrugated member comprising a front end and a back end and an internal corrugated area; and an internal clamping member at least partially disposed within the internal bore of the back nut;

wherein axial advancement of the back nut in the direction of the front end of the body causes at least a portion of the internal clamping member to compress radially inwardly.

2. The coaxial cable connector of claim 1, wherein the internally corrugated member comprises an internal bore between the internal corrugated area and the back end of the internally corrugated member.

3. The coaxial cable connector of claim 2, wherein the internal clamping member is at least partially disposed within the internal bore of the internally corrugated member in a final stage of assembly with the coaxial cable.

4. The coaxial cable connector of claim 1, wherein the internal clamping member comprises a forward facing annular shoulder that abuts against the back end of the internally corrugated member in a final stage of assembly with the coaxial cable.

5. The coaxial cable connector of claim 1, wherein the internal clamping member contacts the internally corrugated member, the cable jacket, and the back nut in a final stage of assembly with the coaxial cable.

6. The coaxial cable connector of claim 1, wherein the back nut does not contact the internally corrugated member in a final stage of assembly with the coaxial cable.

7. The coaxial cable connector of claim 1, wherein the connector comprises a contact comprising a plurality of contact tines for establishing mechanical and electrical communication with the center conductor of the coaxial cable.

8. The coaxial cable connector of claim 1, wherein the connector comprises an insulator disposed between the contact and the body.

9. The coaxial cable connector of claim 1, wherein the connector comprises a ring disposed between the internally corrugated member and the front end of the body.

10. The coaxial cable connector of claim 9, wherein the ring comprises a tapered protrusion and the outer conductor of the coaxial cable is clamped between the internally corrugated member and the tapered protrusion in a final stage of assembly with the coaxial cable.

11. A method of coupling a coaxial cable having a center conductor, a cable jacket, and an outer conductor to a coaxial cable connector, the method comprising:

inserting a prepared end of the coaxial cable into a coaxial cable connector, the coaxial cable connector comprising:

a body comprising a front end, a back end, and an internal bore;

a coupling nut rotatably secured to the front end of the body;

a back nut rotatably secured to the back end of the body, the back nut comprising an internal bore;

an internally corrugated member at least partially disposed within the internal bore of the body, the internally corrugated member comprising a front end and a back end and an internal corrugated area; and an internal clamping member at least partially disposed within the internal bore of the back nut; and axially advancing the back nut in the direction of the front end of the body thereby causing at least a portion of the internal clamping member to compress radially inwardly.

12. The method of claim 11, wherein the internally corrugated member comprises an internal bore between the internal corrugated area and the back end of the internally corrugated member and the internal clamping member is at least partially disposed within the internal bore of the internally corrugated member in a final stage of assembly with the coaxial cable.

13. The method of claim 11, wherein the internal clamping member contacts the internally corrugated member, the cable jacket, and the back nut in a final stage of assembly with the coaxial cable.

14. The method of claim 11, wherein the back nut does not contact the internally corrugated member in a final stage of assembly with the coaxial cable.

* * * * *